United States Patent [19]

Gorton et al.

[11] 3,982,800

[45] Sept. 28, 1976

[54] ROTARY-POSITION CATCH FOR ROTATABLE CORNER SHELF UNITS

[75] Inventors: Howard Bryon Gorton, San Gabriel; Warren Hall Miller, Claremont, both of Calif.

[73] Assignee: Ajax Hardware Corporation, City of Industry, Calif.

[22] Filed: Feb. 23, 1976

[21] Appl. No.: 660,372

[52] U.S. Cl. ..... 312/305; 312/238; 312/135

[51] Int. Cl.[2] ..... A47B 81/00

[58] Field of Search ..... 312/305, 125, 197, 135, 312/11, 209, 238

[56] References Cited

UNITED STATES PATENTS

| | | | |
|---|---|---|---|
| 379,252 | 3/1888 | Thatcher | 312/135 |
| 456,728 | 7/1891 | Lamson | 312/305 |
| 1,101,880 | 6/1914 | Quinn | 312/305 |
| 3,160,453 | 12/1964 | Tassell | 312/238 |
| 3,281,195 | 10/1966 | Shownes | 312/209 |
| 3,733,112 | 5/1973 | Marquardt | 312/125 |
| 3,868,156 | 2/1975 | Vander Ley | 312/238 X |

*Primary Examiner*—Robert L. Wolfe
*Assistant Examiner*—Victor N. Sakran
*Attorney, Agent, or Firm*—Dallett Hoopes

[57] ABSTRACT

Rotary storage unit carries outward lugs. Support surface carries an oblong plastic ring surrounding lug area. Ring is supported adjacent ends of major diameter only. Ring and lugs are dimensioned to forcibly interengage adjacent minor diameter of the ring, distorting the ring. Ring is recessed at ends of minor diameter so that lugs snap into recesses when unit is moved into certain rotary position. This snap engagement serves as a catch for holding the unit in "closed" position.

7 Claims, 6 Drawing Figures

ROTARY-POSITION CATCH FOR ROTATABLE CORNER SHELF UNITS

BACKGROUND OF THE INVENTION

1. Field of the Invention

This invention relates to a rotary-position catch for rotatable storage units. More specifically, this invention relates to a catch for holding rotatable corner-type shelves in the closed position.

2. Description of the Prior Art

It has been common in the past to provide in kitchen cabinets corner shelves of the rotatable or "lazy susan" type. Such shelves have become popular because without them much cabinet space in the corner position either above or below the kitchen counter is wasted and not used due to the inaccessibility of items well back in the corner.

Basically, rotatable corner shelf units have taken either of two forms: structures in which a tubular element forms the vertical rotatable axis of the shelves, and forms in which the cabinet door has formed the vertical member and bearings have been disposed on or adjacent the upper and lower shelves.

Cabinet closures for rotatable shelves have also taken two forms. In one form, the closure has comprised a door formed of two vertical panels disposed at right angles to each other so as to be flush with the planes of the cabinet opening when the shelf unit is closed. These panels have been secured directly to aligned pie-sliced-shaped cut-outs in the shelves. Alternatively, the closure has taken the form of a door also formed of right angularly disposed vertical panels, but hinged to the cabinet door frame so as to swing closed. To permit such a closure, shelves or trays of units in the latter category have been notched in aligned pie-sliced-shaped openings so that the hinged door can be closed without interference from the shelves.

In all of the above structures, it is highly desirable to have catch means holding the shelves in the proper rotary position for closure so that in the first category of structures the door panels remain flush with the cabinet opening, and in the second category, the notches remain aligned with the opening so that the hinged door can readily close.

Rotary-position catches for rotatable shelves have taken many forms in the prior art. An example is shown in the U.S. Pat. No. 3,281,195, granted Oct. 25, 1966 to Anderson. In this patent, a fixed, notched, drum-like cam is disposed surrounding the axis of the shelves. A spring-biased roller follower is secured on the shelving closure and the parts are oriented so that the follower rests in the notch when the shelving door is in the closed position. Such structures of the prior art are complicated and require many parts and difficult assembly.

Another arrangement is presented in U.S. Pat. No. 3,868,156 which issued Feb. 25, 1975 to Vander Ley. In the structure shown in this patent, the shelving is free for a limited vertical movement and the bottom bearing presents a downward face cam which cooperates with an upward complementing face cam on the shelving mounting bracket. The arrangement is that the face cams interfit permitting the slight dropping of the storage unit when the shelves are in closed position. Thus, gravity serves as the catch. For the unit to open in either direction, the rotary face cam must be rotated against the force of gravity in a lifting operation. The primary drawback of such structures in the prior art is that they have required vertical movement of the shelving in shipping and installation. Moreover, the necessity for vertical movement has required significant clearances in the dimensioning of the shelving door frame.

SUMMARY OF THE INVENTION

Under the present invention, the catch comprises essentially two parts. The first is a catchring/bearing unit adapted to be secured at the upper end of the shelving axis on the underside, for instance, of the kitchen counter. It comprises a plate having a central downward bearing, and an oblong plastic ring surrounding and spaced from the bearing. The oblong ring is secured to the plate at only two zones diametrically opposite, the zones being disposed at the ends of the major diameter of the oblong ring. The ring is formed with recesses on the inner surface at the ends of minor diameter thereof.

The other part is a socket sleeve which engages the bearing on the mounting plate and is provided with a pair of outward lugs which extend out far enough to forcibly engage the catchring at the ends of the minor diameter. Catching is achieved when the shelving structure rotates to a position in which the lugs snap into the recesses.

Because the sleeve may be clamped to the tubular support of the shelving unit in any relative rotary position, the exact alignment position of the door with the catching position can be accurately established. Benefits over the prior art include extremely simple construction and foolproof operation combined with durability. Further, any need for vertical movement of the shelving unit is eliminated.

In addition, the structure of the present invention is extremely easy to install and it requires consistent catching and uncatching torque irrespective of the loading on the shelves.

BRIEF DESCRIPTION OF THE DRAWINGS

Other objects and features of the invention will be apparent from a review of the following specification and reference to the accompanying drawings, all of which disclose a non-limiting embodiment of the invention. In the drawings.

DESCRIPTION OF THE PREFERRED EMBODIMENT

Figure 1:
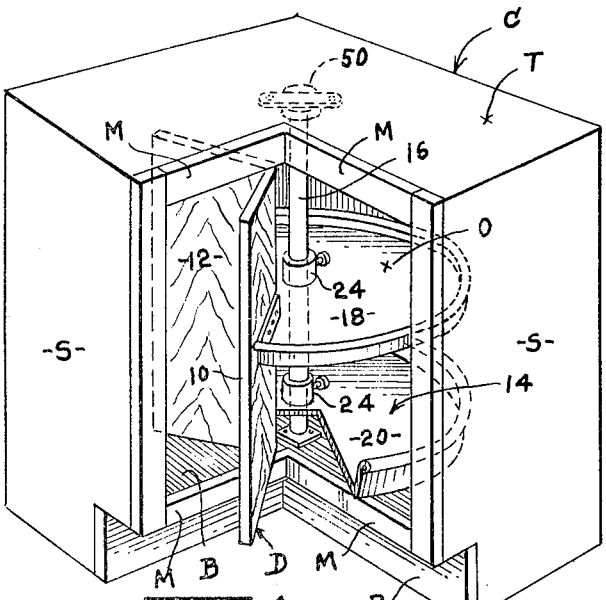
FIG. 1 is a perspective view of structure embodying the invention installed in a corner cabinet and showing the storage unit in open position, as in use.

A cabinet including structure embodying the invention is generally designated C in FIG. 1. It comprises a top wall T which, in a kitchen environment, for instance, would be covered by a conventional kitchen counter of formica or the like. The cabinet is provided with a toe recess R and a bottom wall B. The sidewalls S of the structure close the ends thereof and the entire cabinet fits typically in the corner of the kitchen floor, the rear edges of the top abutting the adjacent sidewalls of the kitchen.

As shown, framing members M present a right-angular opening O of the cabinet and this opening is provided with a door D comprising a pair of right-angularly-disposed vertical panels 10 and 12. When the door D has its panels aligned respectively with the right-angularly-disposed framing members M, the unit is in "closed" position. In all other positions of the door, the unit is "opened". It is the object of the present catching structure to hold releaseably the door D in "closed" position so that, except during use, material in the cabinet is closed from access and view.

Figure 2:
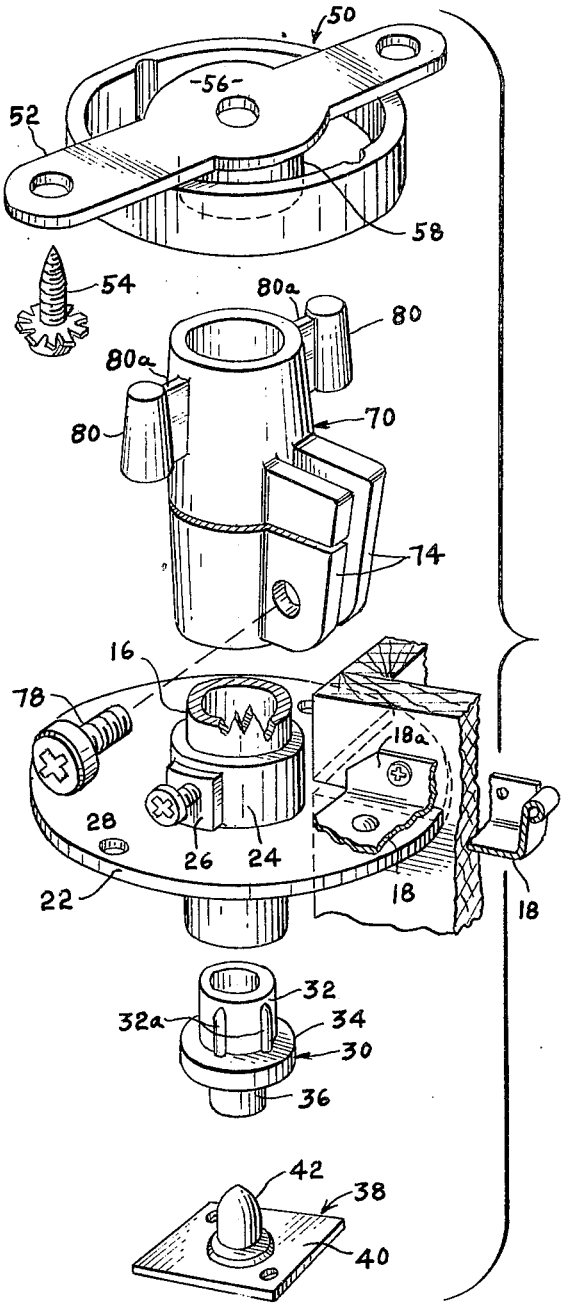
FIG. 2 is an enlarged exploded perspective view, with various parts eliminated for simplification, of the shelf unit structure shown in FIG. 1.
Figure 3:
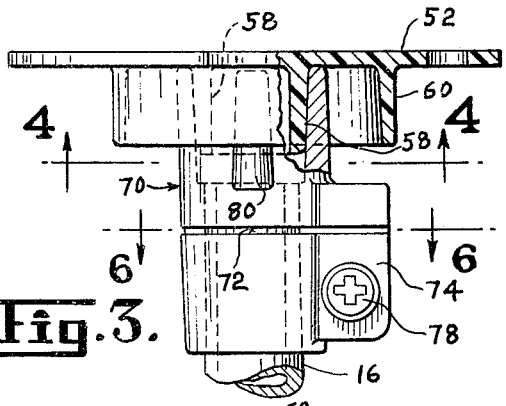
FIG. 3 is a fragmentary side elevation of the rotary-position catch embodying the invention with the ring partly in section.

The storage assembly shown in FIG. 1 is generally designated 14. It comprises a vertical tubular element 16 mounted for rotation about its own longitudinal axis by bearing means secured in the cabinet. Reference to FIGS. 1 and 2 indicates that the unit also includes typically a pair of shelves or trays 18, 20. Typically, one of these trays 18, shown in fragmentary fashion in FIG. 2, is apertured at its center to receive the tube 16 and superposes and is riveted to the flange 22 of a clamping sleeve 24. The clamping assembly includes a nut 26 welded to the sleeve 24 so that the opening in the nut aligns with an opening underlying the nut, and a bolt or set screw 28 threadedly engaging the nut 26 extends through and clampingly engages the tube or shaft 16 to establish the fixed rotary position of the shelf 18 on the tube.

The shelves or trays 18, 20 are formed with vertically aligned pie-sliced-shaped cut-outs having at their respective borders upward margins as illustrated at 18*a*. The trays are suitably spaced on the shaft or tube 16. Door panels 10 and 12 (FIG. 1) are secured in the cut-outs by screws extending into the panels through suitable openings in the margins of the trays. It will be understood that the door D, being secured to the trays, augments the strength of the shelving structure.

Bearing means at the lower end of the tube 16 comprises a pivot bushing 30. Bushing 30 presents a sleeve 32 having outward longitudinal ribs 32*a*, a stop flange 34, and a downwardly-facing thrust cup 36 which has an upward recess at its lower end (not shown). A bottom pivot pin 38 is provided and comprises a plate 40 suitably apertured to be secured to the floor B of the cabinet and having an upward pointed bearing pin 42. In assembly, the sleeve 32 of the pivot is shoved home upwardly into the lower end of the tube 16 until the stop flange 34 abuts the lower end of the tube. Subsequently, the thrust cup is maneuvered down over the bearing 42 to operatively rest thereagainst.

Figure 4:
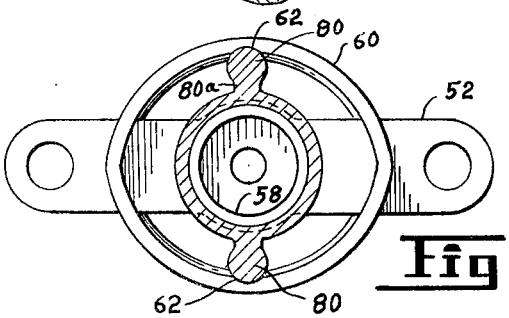
FIG. 4 is a sectional view taken on the line 4—4 of FIG. 3 and showing the structure in catched position.

Attention is now directed to the upper bearing wherein the invention resides in the embodiment shown in the drawings. The bearing and catch comprises preferably two parts. The first is the stationary element 50 which is preferably integrally molded of plastic such as Nylon or Delrin, an acetal. It includes an elongated mounting plate 52, suitably apertured at either end to receive fasteners as at 54, to be secured into the underside of the cabinet top T immobilizing the element 50. Centrally, the plate is enlarged as at 56 and is formed with a downwardly extending tubular bearing sleeve 58. An oblong catchring 60 is provided and is formed integrally with the plate 52 in zones of the ring which are at the opposite ends of the major diameter of the oblong structure (FIG. 4). The ring is preferably of uniform thickness in cross section, and presents a height substantially equal to the height of the sleeve bearing 58.

On its inner surface at the opposite ends of its minor diameter, the oblong ring is formed with longitudinal grooves 62 or recess means.

Figure 6:
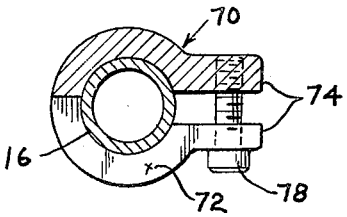
FIG. 6 is a sectional view taken on the line 6—6 of FIG. 3.

The second part of the bearing-and-catch assembly in the embodiment shown is the sleeve element 70. As shown, it is of substantial height and is slitted as at 72 on the horizontal (FIG. 6), the portions below the slit being split and formed with ears 74 which are apertured in alignment and preferably one of which is threaded to receive a clamping screw 78. By this means, when the desired rotary position of the sleeve 70 on the tube 16 is established, the screw 78 may be tightened, firmly fixing the position of the sleeve in its proper rotary position with respect to the shelving. Additionally, the sleeve is useful in the assembly of the unit in that the lower bearing assembly is first established with the sleeve 70 down on the tube. The upper end of the tube is then brought into alignment with the bearing 58 and the sleeve 70 is raised and clamped at the proper height and rotary position, as described.

The sleeve 70 is formed with a pair of outward diametrically opposed catch lugs, projections or ears 80. These are preferably frusto-conical, tapering as their upward ends are approached, and are connected to the sleeve by webs 80*a*. The ears are of a height greater than the ring 60 and the outer portion of their surfaces, that is, the portion of their surfaces farthest from the axis of the tube 16 are approximately as far away from the axis as the outer portions of the grooves 62 or recesses.

Referring now to FIG. 4 wherein the structure is shown in catched position, it will be seen that the ears 80 engage in the grooves 62. It is in this disposition, by virtue of the relative arrangement of parts, that the door D is in "closed" condition, aligned with the respective frame members M. As can be imagined, the resilient nature of the ring 60 creates a yieldable impedement as rotary movement of the shelving away from the "closed" position is attempted. Thus, for the ears 80 to be moved out of the grooves 62 requires an outward deformation of the catchring in areas adjacent the grooves 62. While this can be readily accomplished by applying appropriate force to the door, there is a tendency, because of the structure described, to keep the door in the catched and closed position.

As can be imagined, when the ears 80 are closely proximate the grooves 62 on either side thereof, the engagement is forcible so that when the curved surfaces of the ears 80 more nearly approach the grooves 62, there is a snapping action, catching the door into closed position. As a result, the door may be casually pushed toward the closed position and the ears 80 will snap into the grooves 62 firmly catching the door, resisting the tendency of the door and storage unit to pass through the "closed" position.

Figure 5:
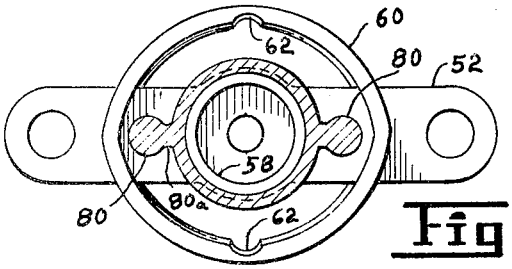
FIG. 5 is a view comparable to FIG. 4 but showing the structure in the uncatched position as when the unit is opened.

As can be gathered from FIG. 5, the ears 80 do not engage the ring 60 at all when the ears are in the zone approaching the ends of the major diameter of the oblong ring. It is in these zones that the ring is integrally anchored to the plate 52.

The structure of a preferred embodiment of the operation thereof has now been described. It should be understood that a large number of variations of the structure disclosed is possible and that while the embodiment shown is preferred, modifications of the structure involving, for instance, reversal of the parts, are contemplated, such modifications offering some of the advantages of the invention.

It is, therefore, clear that the invention is not limited to the embodiment shown but is of the scope of the following claim language including equivalents thereof:

We claim:

1. A rotary-position catch for rotatable storage units comprising an integral plastic mounting plate having a central pivot bearing for the unit and an oblong resilient ring surrounding the bearing and joined to the plate at diametrically opposite points on a major diameter, the ring having recess means at diametrically opposite points on a minor diameter; and a sleeve having outward catch-engaging lug means, the sleeve being adapted to be secured to the storage unit on the axis of rotation thereof, said lug means extending outward from the sleeve to a point slightly farther from the axis than the ring at the minor diameter whereby the lug means forcibly engages the ring when adjacent the recess means and snaps into the recess means to effect the catching action.

2. For a corner-cabinet lazy-susan-type storage unit a catch for holding the unit in a preset rotary position comprising a plastic mounting plate adapted to be mounted on a support surface and having an integral central pivot bearing and an integral oblong ring surrounding the bearing and mounted on the plate at opposite points on its circumference at which the diameter of the ring is greatest, the ring having recess means on its inner surface adjacent the ends of narrowest diameter; and a positioning sleeve adapted to be disposed on the axis of the unit and to engage the bearing, at least one outward projection on the sleeve adapted to ride forcibly against the inner surface of the ring at least in the narrower diameters of the ring, flexing the ring and adapted to snap into the recess means to relatively stabilize the unit in a preset rotary position.

3. For a corner-cabinet lazy-susan-type storage unit a catch as claimed in claim 2 wherein the ring is provided with a pair of diametrically opposite recesses and the sleeve is provided with a pair of diametrically opposed projections, the projections extending out to the depths of the recess.

4. For a corner-cabinet lazy-susan-type storage unit a catch as claimed in claim 2 wherein the sleeve is adapted to be disposed on the axis of the unit and includes clamp means to fix its rotary position on the unit.

5. For a corner-cabinet lazy-susan-type storage unit a catch as claimed in claim 2 wherein the projection is a tapered cylinder narrowing as the end of the sleeve more remote from the center of the unit is approached.

6. A storage unit including a shelf assembly, mounting means mounting the assembly for rotation about a vertical axis, said mounting means comprising a mounting plate adapted to be fixedly secured to a horizontal surface, the plate having a fixed pivot boss and a resilient oblong ring surrounding the boss, the inner surface of the ring having an outward recess at a point at which the inside of the ring has a narrower diameter, and a pivot bearing in the shelf assembly operatively engaging the boss, the bearing having an outward projection adapted to forcibly engage the ring at the narrower diameter of the ring as the assembly is rotated and to snap into the recess means to fix yieldably the rotary position of the assembly.

7. A lazy-susan-type storage structure for a corner cabinet structure and catch means for holding the storage structure in a preset rotary position, the catch means comprising an oblong resilient plastic ring having an axis coincident with the axis of the storage structure, the ring being mounted on one of the structures by integral means secured to the ring adjacent points on the circumference at the opposite ends of a major diameter thereof, the ring having a recess in its inner surface at the ends of a minor diameter thereof, and lug means fixedly mounted on the other of said structures and disposed with its outer surface at a distance from the axis of the storage unit equal to the distance from the axis to the farthest point of the recess, whereby as the unit rotates, the lug means forcibly engages the ring adjacent the recess as rotary movement is imparted to it and snaps into the recess to yieldably hold the storage unit structure in said preset rotary position.

* * * * *